United States Patent [19]

Barnes

[11] 4,270,774

[45] Jun. 2, 1981

[54] METHOD OF MAKING BINGO OR TOMBOLA TICKETS AND ARTICLE PRODUCED THEREBY

[75] Inventor: Gerald W. Barnes, Ipswich, England

[73] Assignee: W. S. Coswell Limited, Ipswich, England

[21] Appl. No.: 25,003

[22] Filed: Mar. 29, 1979

[30] Foreign Application Priority Data

Apr. 8, 1978 [GB] United Kingdom ..... 13869/78

[51] Int. Cl.[3] ..... B42D 15/00

[52] U.S. Cl. ..... 283/62; 281/3 R; 281/3 A; 281/5

[58] Field of Search ..... 270/18; 283/48 R, 48 A, 283/49, 50, 62; 281/2, 3 R, 3 A, 5

[56] References Cited

U.S. PATENT DOCUMENTS

| | | | |
|---|---|---|---|
| 444,106 | 1/1891 | Spraker | 225/32 X |
| 3,900,219 | 8/1975 | D'Amato et al. | 283/8 R X |
| 3,917,276 | 11/1975 | Green Barg | 283/62 X |
| 3,956,049 | 5/1976 | Johnsen | 283/8 B X |
| 3,998,446 | 12/1976 | Dent | 270/18 |

*Primary Examiner*—Paul A. Bell

*Attorney, Agent, or Firm*—Le Blanc, Nolan, Shur & Nies

[57] ABSTRACT

Tombola or bingo tickets and booklets of tickets are manufactured in continuous strip form which is concertinaed or fan-folded at intervals of every six or twelve tickets; the strips form caters for the differing ticket or booklet requirements of different players and reduces the high wastage rate which arises when the common demand of three or four tickets or booklets is met by suppliers whose stock is in the form of tablets containing strips of six interconnected tickets or booklets. The continuous strip is weakened transversely between every ticket or booklet to aid detachment thereof from the strip. The number combinations are printed on tickets which are so organized that all the numbers which may be called during a game will be found once, twice, thrice or four times in the tickets located between each pair of adjacent folds in the strip.

15 Claims, 4 Drawing Figures

METHOD OF MAKING BINGO OR TOMBOLA TICKETS AND ARTICLE PRODUCED THEREBY

Figure 1:
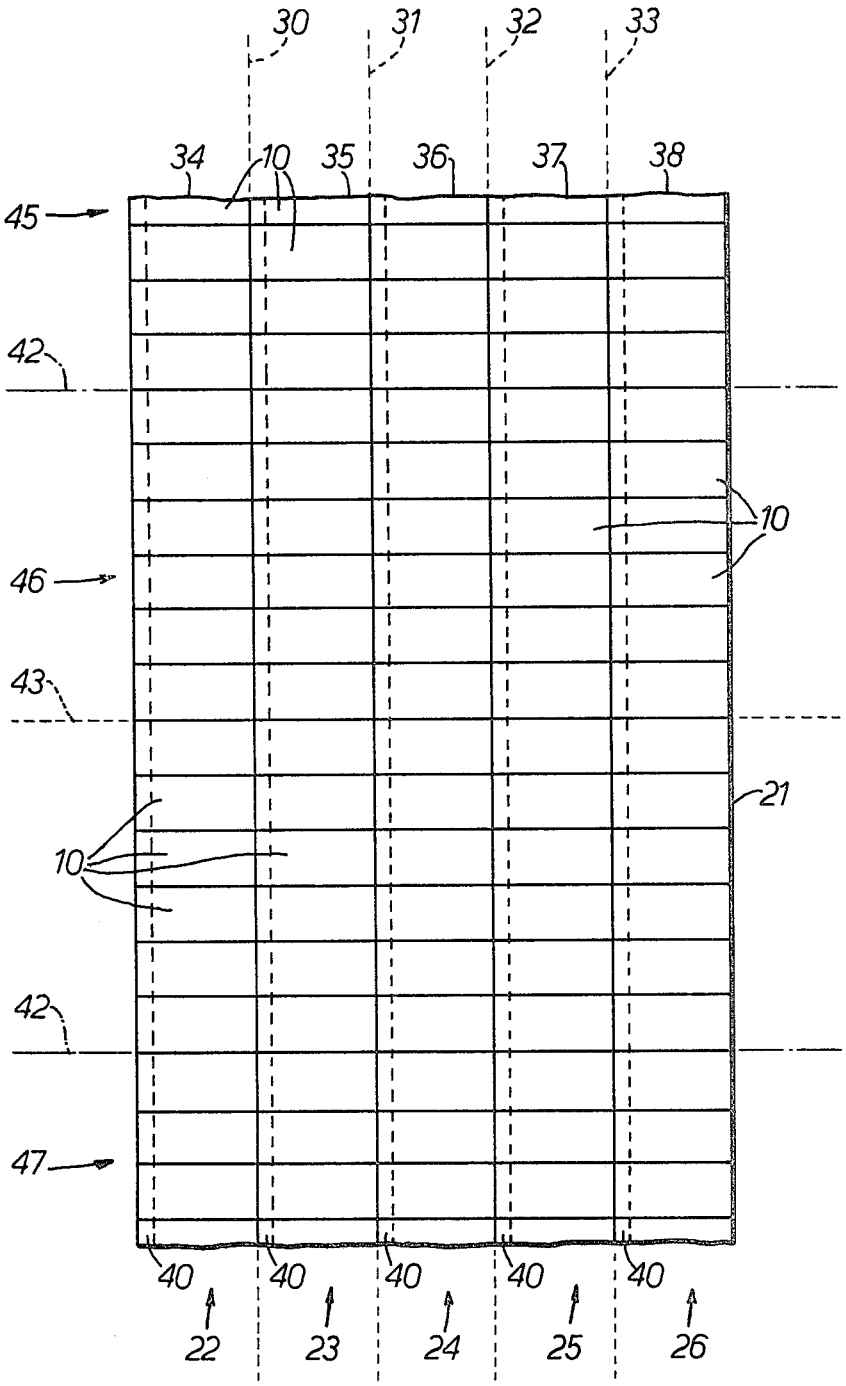

The present invention relates to Bingo or Tombola ticket improvements.

Tickets to which this invention relates can be in a form suitable for playing individual games, or in a form suitable for playing a series of games in a play session. In the latter case, the tickets will be supplied as is conventional as books or booklets, each page of each book or booklet comprising a ticket for use in a different game of the series thereof.

In one aspect, the invention is a modification of the invention claimed in our U.S. Pat. No. 3,998,446 of which we are the assignees.

The present invention provides a method of producing a set of tombola or bingo ticket booklets each comprising differently coded tickets coded by colour, background pattern, or by code means other than the combinations of numbers printed on the tickets, the booklets in the set having the coded tickets arranged in a predetermined order or code sequence common to all the booklets and the method including the steps of (a) identically printing the different number combinations which are to appear in the set of booklets on one or both sides of each of a plurality of webs coded as aforesaid, the number of webs being determined by the number of tickets to be in each booklet, (b) superposing the coded webs in the said predetermined order upon a further web on which booklet covers have been printed, the identically printed webs being superposed one upon another with their printed number combinations in step-shifted registration, the step shifted registration effected being such that the number combinations borne by the tickets in each booklet differ from one another, (c) thereafter uniting the webs superposed upon one another to produce an elongated strip constituting a multiplicity of contiguous booklets of tickets having their ticket pages and booklet covers secured together along one edge of the strip, and (d) fan-folding the strip transversely of its length.

Conveniently, but not essentially, the webs are transversely perforated at regular intervals along their lengths, e.g. after every six or twelve booklet spacings, and the united webs forming the said strip are fan folded along the perforations.

It may be helpful to the user to perforate the strip transversely between each adjacent pair of booklets, to facilitate separation of one or more booklets from the strip to meet a customer's requirements.

Optionally, the webs each have a width which is a multiple of the width of the booklet strip, and the tickets are printed on the webs in a plurality of longitudinally-extending bands disposed side-by-side across the webs, and the webs are severed longitudinally to separate the bands to form a plurality of booklet strips. Before severing, the webs are furnished with means for uniting them. The said means can be constituted by transversely-spaced, longitudinally-extending glue lines. The webs can be severed either before or after they are actually united. Stitching could be substituted as the means for uniting the webs.

The invention embraces the product of the method defined in the four preceding paragraphs.

According to another aspect of the invention, there is provided a method of making a set of tombola or bingo tickets, each ticket having a combination of playing numbers thereon which is different from the combinations on the other tickets of the set, comprising printing the different number combinations which are to appear in the set of tickets on one or both sides of a single web strip, and then folding the web strip transversely at regular spaced intervals along its length to form the web strip into a fan-folded configuration. In practising this method, the tickets can again be printed in a plurality of bands disposed side-by-side across the web, which is subsequently severed into a plurality of ticket strips. These strips can, if desired, be joined endwise one to another.

The ticket strip produced by this method comprises a single sheet (printed on one or optionally both sides). Its tickets are primarily meant for use in playing so-called "interval games".

The ticket strip can feature transverse perforations with which the fan-folding folds coincide, and if desired to facilitate detachment of tickets from the strip.

The invention further provides a set of tombola or bingo ticket booklets which are interconnected one to another and each comprising differently coded tickets coded by colour, background pattern, or by code means other than the combinations of numbers printed on the tickets, the booklets in the set having the coded tickets arranged in a predetermined order or code sequence common to all the booklets, the number combinations borne by the tickets in each booklet differing from one another, and the set of tickets being printed on one or both sides of a plurality of continuous, elongated web strips so as to follow one another along the continuous strips, the web strips being united one to another and to a further web strip which constitutes a set of covers of the booklets, and the unitary strip forming the interconnected ticket booklets being folded transversely at regular intervals along its length into a fan-folded configuration.

Moreover, the invention provides a set of tombola or bingo tickets each having printed thereon a combination of playing numbers that is different from the combinations borne by the other tickets in the set, the tickets being printed on one or both sides of a continuous, elongated web strip so as to follow one another along the length of the web strip, said strip being folded transversely at regular intervals along its length into a fan-folded configuration.

Ticket or booklet strips embodying the invention are intended to simplify and accelerate point-of-supply operations in Bingo halls. Hitherto, bingo tickets or booklets have conventionally been supplied in strips of six tickets or booklets. Experience shows, however, that it is relatively rare for customers to purchase so many at a time, although some do and some buy more, but most customers purchase more than 1 or 2 e.g. 3 or 4 tickets or booklets each. This involves the point-of-supply attendants in tearing off the requisite number of tickets or booklets from the strips of six. This is time-consuming and can create long queues of customers, besides entailing other well-recognised drawbacks.

By providing the tickets or booklets in elongated, fan-folded strip form can simplify operations, especially if the strip is used in conjunction with a dispenser. Whilst a suitable dispenser could be made semi-automatic, a manual dispenser might be preferred. Such a dispenser could comprise a container box having an opening through which the strip is drawn, and means such as one or more cutting blades, against which the attendant simply pulls the strip to sever the requisite number of tickets of booklets.

Figure 2:
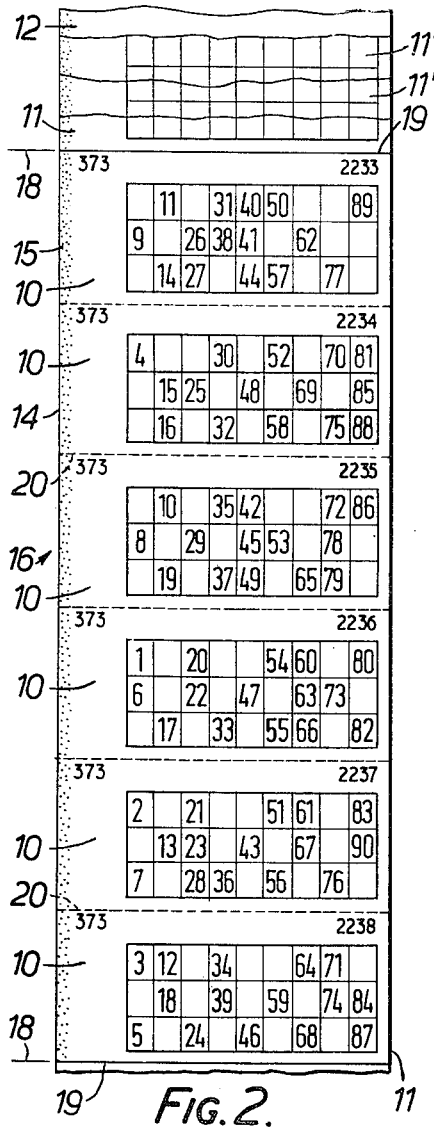
Figure 3:
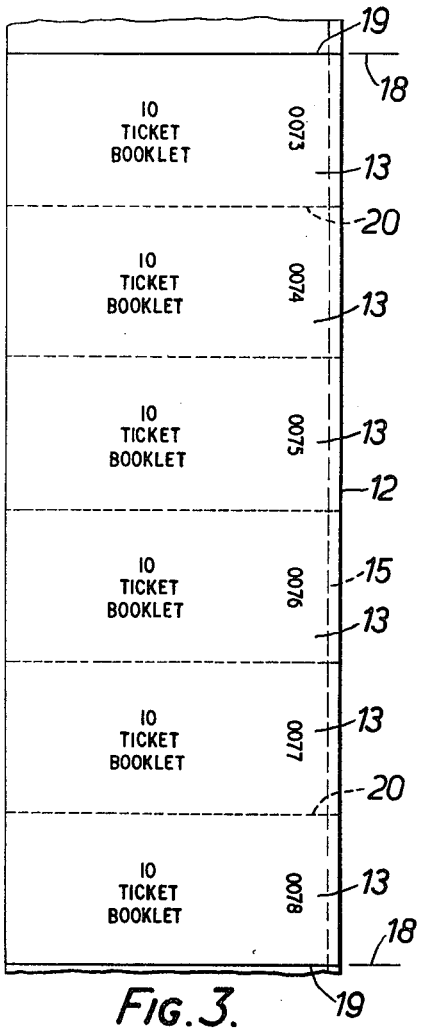
Figure 4:
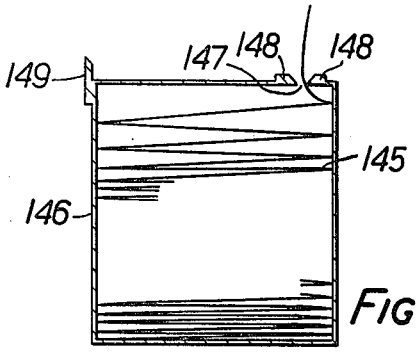

The invention will now be described by way of example only with reference to the accompanying drawings, in which:

FIG. 1 diagrammatically illustrates the manner of printing a web and other features embodied therein, in accordance with the present invention, FIG. 2 illustrates a portion of a ticket or booklet strip embodying the invention, FIG. 3 illustrates a cover page strip for a booklet strip according to the invention, and FIG. 4 shows a dispensing container box having a fan-folded ticket or booklet strip therein ready for dispensing.

The terms "tombola" and "bingo" used in this specification and the appended claims refer to similar number games: "Tombola" (called bingo in the U.K.) is a lottery in which fifteen of the numbers from 1 to 90 are called at random and "bingo" is a lottery in which twenty five of the numbers from 1 to 75 are called at random.

As is well known and as shown in FIG. 2, a tombola ticket 10, six of which are illustrated in detail, usually presents a printed grid having nine vertical columns of rectangular boxes arranged in three horizontal rows. Certain of the boxes are numbered with different numbers printed on the ticket and the remainder are left blank. Presupposedly, all the tombola players who purchase tickets have a different combination of an equal number of numbers on each ticket so as to have, with each ticket, an equal chance of winning the game.

The number of possible combinations of fifteen numbers selected from 1 to 90 is astronomical, but for practical purposes relatively small sets of combinations are devised. Such sets may, for instance, have approximately 6,000, 12,000 or 18,000 different combinations of fifteen numbers.

In one particular exemplary set or sequence of tombola tickets at present supplied to the Trade there are twelve thousand different combinations of fifteen different numbers selected from the numbers "one" to "ninety" inclusive. The twelve thousand different combinations are printed on up to ten different colours of colour coded paper so as to give a sequence of tombola tickets consisting of a maximum of one hundred and twenty thousand tickets not one of which has both the same combination of numbers and the same colour as any other ticket in the sequence. The tickets are supplied to the trade as "units". A unit is a set or edition of tickets which contains a maximum of one hundred and twenty thousand different tickets, assuming the unit in question is printed on ten differently coded papers. Smaller units may be supplied in which the number of coded papers is limited, e.g. to three or five such papers. Then, the corresponding units comprise thirty six or sixty thousand differing tickets, respectively.

Usually, the ticket units are supplied in booklet form; each booklet has a number of differently coded ticket pages, e.g. three, five or ten, as well as one or two end or cover papers. Like the individual tickets forming the individual ticket pages, the cover paper(s) are numbered and/or otherwise marked to assist checking during manufacture and to afford security against cheating.

In practising the present invention, use can be made of techniques disclosed in the specification of U.S. Pat. No. 3,998,446 which is incorporated herein by reference.

Thus, webs of paper are printed with generally all the different number combinations to appear in the set or unit, using an endless-loop belt press in one pass or complete circulation of the belt. Depending on the size of the belt press, however, it may be possible only to print a fraction of the complete set of say 12,000 tickets in one pass of the belt. The belt capacity might, for instance, only accommodate sufficient printing plates to print 6,000 tickets in one pass, so changing of the plates will be necessary to allow printing of the other 6,000 tickets in this particular set.

The belt press is arranged during its circulation to print sequentially a plurality of webs 11 of paper, each readily distinguished from one another e.g. by being differently coloured. The webs 11 are individually printed at respective printing stations and are then brought together in a step-shifted relationship with one another. The step-shifting is such that, despite all the webs being identically printed by the same printing belt of the press, none of the booklets ultimately produced has any ticket which has both the same number combination and the same colour as any other ticket in the other booklets in the set. The step-shifted webs are assembled with a further web 12 printed to form a series of cover pages 13, six of which are shown in FIG. 3. All the webs 11, 12 are then united along one edge, viz the left hand edge 14 seen in FIG. 2. To this end, the webs can be furnished with a marginal glue line 15. The cover web 12 is placed beneath the stack of step-shifted webs, 11, 11', 11''. It will be appreciated that the printed side of the cover web 12 will face away from the ticket printing seen in FIG. 2. After uniting, an elongated strip 16 of ticket booklets results.

Alternately, the webs 11, 12 could be stitched to one another along edge 14.

At regular intervals of every six or preferably twelve tickets, the assembled and united webs 11, 12 are folded. The folding is transverse to the length of the elongated strip 16 of ticket booklets, but is in alternating directions so as to produce a zig-zag, concertina or fan-fold formation. The folds can be made along lines 18 between adjacent pairs of ticket booklets, the said lines 18 coinciding with lines of perforations 19. Each of the webs 11, 12 are perforated at 19.

To ease detachment of booklets from the strip 16 further lines of weakness, produced by perforations 20, can extend transversely through the webs 11, 12. Perforations 20 are located between adjacent booklets.

In principle, a strip 16 six thousand tickets long could be produced from a printing belt substantially equal in width to the transverse dimension of the strip 16. Measured longitudinally, each ticket and booklet may be 1½" or 2" long. Thus a belt long enough to print such a strip 16 in one pass would have to be inconveniently long (750 or 1000 feet). If a belt 200 feet long were available, twelve hundred booklets could be produced in one pass. If the printing plates carried by the belt were changed five times and printing runs were made each time, six thousand booklets in five strip lots could readily be made. Five booklet strips, one from each run, could be joined endwise one to another to form the single elongated strip 16 containing six thousand booklets.

Preferably, however, both the printing belt and the webs have widths which are multiples of the transverse dimension of the strip 16. For example the belt and webs can be five times the said dimension in width. The belt can be 200 feet long. Such a belt can be used to print coded webs each with as many as six thousand 2" long tickets. The tickets printed on each web are disposed side-by-side in five rows or bands extending longitudinally of the web 21, as seen in FIG. 1. Each row or band 22 to 26 thus contains twelve hundred different tickets 10 which are produced in each complete pass or circulation of the belt.

The webs 21, leaving their respective printing stations are step-shifted as before and assembled with at least one cover web. The assembled webs are then united and severed longitudinally. The order in which uniting and severing are accomplished is basically immaterial, and the two steps could be conducted simultaneously. The webs are severed along lines 30, 31, 32 and 33 into five elongated booklet strips 34, 35, 36, 37 and 38, each comprising twelve hundred booklets. The five booklet strips 34 to 38 may be spliced together endwise to form a single strip of six thousand booklets.

The webs forming each booklet strip 34 to 38 could be united by stitching.

Alternatively, the webs could each be provided with uniting means represented by longitudinally-extending glue lines 40. If a hot melt glue is used, it could be activated at five sets of heated pinch rollers located before or after cutting wheels which sever the webs along the lines 30 to 33. The said rollers could be integral with the cutting wheels instead, but a further roller would be needed for activating the glue line 40 at the extreme left hand edge of the assembled webs.

As described hereinbefore, the assembled webs are subjected to a fan-folding operation. In this case, the folds occur every twelve booklets along transverse lines 42. The folds may occur every six booklets in which case folds are made also along lines corresponding to line 43. Where the folds are, there is a transverse line of perforations. Further lines of perforation may be provided between each pair of adjacent booklets to facilitate detachment of booklets from the strip 16.

When fan folded at twelve booklet intervals, section 45 will underlie section 46 if section 47 overlies the section 46.

It will be appreciated that a single booklet strip of six thousand booklets will have a substantial bulk when fan-folded. It may be convenient, therefore, to package the strips in sub-lots containing fewer booklets. Each sub-lot may contain twelve hundred booklets and be formed by a respective one of the five rows 22 to 26.

Booklet strips produced as hereinbefore described provide booklets containing a plurality of ticket pages. Each page is used for a different game in a series of games or game session. The number of pages will equal the number of games in the session assuming the pages are printed on one side only.

An evening's tombola session may consist of two halves, with an interval therebetween. There is often a demand for "quickie" or "interval" games, consisting of single games not forming part of a session. For such games single tickets rather than booklets thereof are needed.

Single ticket strips can be produced in accordance with the invention for such quickie or interval games. Only one web 11 or 21 is printed rather than as many as ten, and cover webs 12 are omitted. As before, the single web is perforated and fan folded. Desirably, the single web is a multiple of the previously-mentioned transverse dimension and is printed in the manner illustrated in FIG. 1. Since a single web is involved, the step of uniting is superfluous. However, splicing the five strips severed from the web printed as shown in FIG. 1 may be performed.

For the bingo promoter's convenience and to speed serving customers, fan-folded ticket and booklet strips can be sold from a dispenser. A convenient dispenser of the fan-folded product 145 comprises a dispenser box or carton 146. Either in its top, as shown, or in one side adjacent the top, the box 146 has an opening 147 through which the product 145 issues. One or better two cutting blades 148 are mounted on the box, with the cutting edge(s) bordering the opening. The edges can be serrated. In use, the bingo ticket seller pulls from the box 146 a length of the product 145 which corresponds to the number of tickets or booklets requested by the customer. The assistant then draws the tickets or booklets across one or other blade 148 to sever the strip transversely at a line of perforations.

A preferred form of box 146 may have no blades adjacent the opening 147, but a single upstanding blade spaced therefrom as indicated at 149. With such a construction, the possibility of the end of the product 145 becoming lost inside the box in the course of severing is substantially eliminated.

The product 145 could be dispensed from an automatic dispenser such as disclosed in our copending patent application of even date herewith.

The tickets shown in FIG. 2 have the usual format for Tombola as played in the U.K. Thus, the number combinations are so printed that on each web, there are successive groups of six printed number combinations each forming six tickets related by the properties that each ticket has fifteen different numbers selected from the numbers 1 to 90, all the numbers from 1 to 90 appearing once only in each successive group of six tickets. Each ticket has twelve empty squares. For the game played in the U.S.A., the number combinations are so printed that on each web, there are successive groups of three number combinations each forming three tickets related by the properties that each ticket has twenty-five different numbers selected from the numbers 1 to 75, all the numbers from 1 to 75 appearing once only in each successive group of three tickets. Each ticket has a grid containing twenty-five spaces all of which contain a number selected from 1 to 75. In a variation of tombola, the same general format as illustrated in FIG. 2 might be chosen, with the numbers limited to selections of fifteen taken from 1 to 75. All the numbers from 1 to 75 would appear once only in every successive group of five tickets.

If desired, webs 11 and 21 could have tickets printed on both sides, in which case two cover webs would preferably be employed.

Although it is preferred from a manufacturer's standpoint to print the web or webs of the fan-folded booklet or ticket strip using an endless-loop belt press, alternative presses could be used. Rotary presses mounting a plurality of ticket printing plates could be employed instead. However, significant labour storage and sorting will be unavoidable because quite frequent plate-changing will become necessary in order to generate a complete set. Moreover, frequent splicing of one strip to another will ordinarily be required if long strips containing as many as twelve hundred, six thousand or more consecutive tickets or booklets have to be made.

For games involving calling the numbers 1 to 90 at random, the number combinations printed on a ticket strip will be so organised that one can find successive groups of six tickets (each bearing fifteen numbers) in which the numbers 1 to 90 all appear once and once only. Ordinarily, if there are six tickets between every pair of adjacent folds, these six tickets will belong to such a group. Should each pair of adjacent folds be spaced apart by twelve tickets, the usual arrangement will involve the twelve intervening tickets forming two complete successive groups of six tickets as aforesaid. Then, each of the numbers 1 to 90 will appear twice amongst the tickets between each pair of adjacent folds. Each number will occur once in the first group of six tickets and once again in the second group. Where a plurality of ticket strips embodying these characteristics are step-shifted appropriately and united into booklets, effectively the same characteristics will be found in groups of six interconnected booklets. Thus, in the six ticket strip forming the first page or leaf of such a group of six booklets, all the numbers 1 to 90 will be found, each number appearing no more than once. The same will be found for the second and every other page or leaf of the six booklets. The booklet strip will be folded every six or twelve booklets and normally such that one or two such complete groups, respectively are located between each pair of adjacent folds.

Generally the same considerations will apply to ticket strips and booklets for games involving calling the numbers 1 to 75 at random. However, in this case the number combinations will be organised such that in a ticket strip one can find successive groups of three tickets (each bearing twenty five numbers) in which the numbers 1 to 75 all appear once and once only. If the strip is folded at six-ticket intervals, so as to have two complete three-ticket groups between each pair of adjacent folds, then the numbers 1 to 75 will each appear twice; the first occurrence will be in one of the two groups and the second occurrence will be in the other group. It follows that where the folds are at twelve-ticket intervals, then where there are four complete three-ticket groups between each pair of adjacent folds, all the numbers 1 to 75 will appear four times. The same characteristics will ordinarily be found in each leaf of booklet strips made from a plurality of such ticket strips, the said strips each forming a leaf or ticket page of the booklet strip.

I claim:

1. A method of making a set of bingo tickets in final, completed form, ready for point of purchase retailing, each ticket having a combination of playing numbers thereon which is different from the combination on the other tickets of the set, each combination being a unique selection of playing numbers from a predetermined plurality of playing numbers callable in a game, comprising grouping the combinations for printing successively such that each group, consisting of a plurality of combinations, contains all the playing numbers callable in a game, printing the combinations on at least one side of a single web strip to form a set consisting of a single strip of printed tickets all connected one to another, and then folding the web strip transversely at spaced intervals along its length to form said strip into a fan-folded configuration, the folds occurring between selected adjacent tickets whereby between each adjacent pair of folds is a plurality of tickets forming an integral number of ticket groups, there being at least one such group, and at view in the tickets in said at least one group are all the numbers which may be called during a game, each number appearing once only in said ticket group.

2. A method according to claim 1, including the steps of transversely perforating the web strip at regular intervals along its length, and fan-folding it along the transverse perforations.

3. A method according to claim 1, including the step of perforating the web strip transversely to form lines of weakness between each adjacent pair of tickets of the said strip, to facilitate detachment of tickets therefrom.

4. A method according to claim 1, wherein all the different number combinations to appear in the set of tickets are printed on the web strip in a single continuous printing operation using a belt printing press during one pass of the belt.

5. A method according to claim 1 wherein the web strip has a width which is a multiple of the ticket width, and the tickets are printed on the web strip in a plurality of longitudinally-extending bands disposed side-by-side thereacross, and the web strip is severed longitudinally to separate the bands to form a plurality of strips of tickets.

6. A method according to claim 5, wherein the said plurality of strips together form a complete set of tickets and the strips are joined endwise one to another to make a unitary fan-folded set.

7. A method according to claim 1 comprising the further steps of providing a predetermined plurality of single strips, coding each said single strip to be readily distinguishable from another single strip, superposing said single strips in a predetermined order with their printed number combinations in a step-shifted registration, uniting the superposed plurality of single strips to produce a single, multi-leaved book of strips, and fan-folding said book at regular intervals along its length, the said step-shifted registration being such that any given game number combination printed on any one of the said single strips is offset longitudinally from the same game number combination printed on all of the other strips, and wherein for each of the superposed strips there is a plurality of tickets at view between each adjacent pair of folds, said plurality of tickets forming an integral number of ticket groups, there being at least one such group, and at view in the tickets in said at least one group are all the numbers which may be called during a game, each number appearing once only in said ticket group.

8. A set of bingo tickets in final, completed form, ready for point of purchase retailing, consisting of a single web strip of tickets, each ticket being printed with a combination of playing numbers, the number combination of each ticket being different from the number combinations of all the other tickets in the set, wherein said combinations are printed on at least one side of said single web strip, said tickets are arranged in successive groups, each group comprising a plurality of tickets and all the playing numbers callable in a game appear once only in said each group, and wherein said single web strip is folded transversely at regular intervals along its length into a fan folded configuration, there being an integral number of groups lying between each adjacent fold, there being at least one such group between each said adjacent fold.

9. A set according to claim 8, wherein the successive groups each comprise six tickets related by the properties that each ticket thereof has fifteen different numbers selected from the numbers 1 to 90, and all the numbers from 1 to 90 appear once only in each successive group of six tickets.

10. A set according to claim 9, wherein the number of tickets located between every pair of adjacent folds is twelve and there are two complete groups of six tickets therebetween.

11. A set according to claim 8, wherein the number of tickets located between every pair of adjacent folds is six.

12. A set according to claim 8, wherein said single strip is associated with a plurality of other of said single strips, all the strips bearing the same printed number combinations but being coded to be readily distinguishable from each other, the said strips being superposed one on another and physically united to form a single multileaved and fan-folded book of interconnected ticket booklets, the superposed strips having their printed number combinations in a step-shifted registration whereby any given number combination printed on any one of the strips is offset longitudinally from the same number combination printed on all the other strips, any given combination appearing only once in any one booklet, and wherein for all the strips there is an integral number of groups of tickets lying between each adjacent fold, there being at least one such group, said at least one group of tickets as aforesaid containing all the playing numbers callable in a game.

13. A set according to claim 12, wherein each of the strips has successive groups of six tickets related by the properties that each ticket has fifteen different numbers selected from the numbers 1 to 90, and all the numbers from 1 to 90 appear once only in each successive group of six tickets.

14. A set according to claim 8, in combination with a dispensing container, the container having a dispensing opening through which the strip can be drawn and means to enable tickets to be severed from the strip.

15. A set according to claim 12, in combination with a dispensing container, the container having a dispensing opening through which the booklet strip can be drawn and means to enable booklets to be severed from the booklet strip.

* * * * *